United States Patent [19]

Boegli et al.

[11] 4,425,106

[45] Jan. 10, 1984

[54] PRODUCTION OF CIGARETTE FILTER UNITS

[75] Inventors: Serge Boegli, Zürich; Jean-Pierre Lebet, Montreux, both of Switzerland

[73] Assignees: F. J. Burrus & Co., Boncourt; Baumgartner Papier SA, Crissier, both of Switzerland

[21] Appl. No.: 197,504

[22] Filed: Oct. 16, 1980

Related U.S. Application Data

[62] Division of Ser. No. 892,086, Mar. 31, 1978, Pat. No. 4,281,591.

[30] Foreign Application Priority Data

Apr. 4, 1977 [CH] Switzerland ..... 4178/77

[51] Int. Cl.[1] ..... A24C 5/50

[52] U.S. Cl. ..... 493/45; 493/49; 493/333; 493/337

[58] Field of Search ..... 493/45, 49, 41, 333, 493/336, 337; 156/291

[56] References Cited

U.S. PATENT DOCUMENTS

| | | | |
|---|---|---|---|
| 2,290,548 | 7/1942 | Galber | 156/291 |
| 3,006,798 | 10/1961 | Holland | 156/291 X |
| 3,316,136 | 4/1967 | Pufahl | 156/291 X |
| 4,208,956 | 6/1980 | Hall | 493/45 X |

*Primary Examiner*—James F. Coan

*Attorney, Agent, or Firm*—Ernest F. Marmorek

[57] ABSTRACT

The invention concerns a method for producing a cigarette filter unit, in which filter elements are disposed on a porous or perforated covering strip and at least partially wrapped thereby and adhesively joined. The adhesive substance is applied to the covering strip along coating tracks which are at least approximately equidistant from each other and extended at an angle to the longitudinal orientation of the covering strip. The filter strand formed in this manner is subdivided by a cutting device.

2 Claims, 14 Drawing Figures

PRODUCTION OF CIGARETTE FILTER UNITS

This is a division of application Ser. No. 892,086, filed on Mar. 31, 1978 now U.S. Pat. No. 4,281,591.

The invention relates to a method for producing a cigarette filter unit in which a sequence of filter elements are disposed on a continuously supplied porous or perforated covering strip, are at least partially wrapped thereby and are adhesively joined and the filter strand formed in this manner is subdivided by a cutting device, apparatus for performing the method and a cigarette filter unit produced in accordance with the method.

In the production of cigarette filters which are provided with porous or perforated covering strips it is known for the side of the covering strip that is to be joined to the plug-like filter elements to be completely provided with adhesive substance. This procedure suffers from disadvantages in that after adhesive joining of the covering strip to the filter elements on the one hand at least a substantial proportion of the porous or perforated places is adhesively joined and air permeability is substantially reduced and on the other hand the degree of air permeability of a covering strip coated in this manner fluctuates from filter to filter over an excessive range so that a precise statement of the percentage of smoke constituents still contained in the cigarette smoke after flowing through such a cigarette filter cannot be stated.

When using porous or perforated covering paper it would be feasible in order to avoid the above-mentioned disadvantages to apply the adhesive substance in thin strips along the longitudinal orientation of the covering paper strip and/or perpendicularly to the longitudinal orientation of the latter. All these solutions would however suffer from the disadvantage that subsequent adhesive joining in the same way of a cigarette filter produced in this manner by means of a porous or perforated connecting paper for connection to the tobacco part would result in substantial variation in the mutual overlapping of the adhesive places and therefore of the air permeability from filter to filter which, as already mentioned, is undesirable. If the covering paper strip were to be adhesively joined to the wrapped filter elements only by means of the adhesive strip which extends in the longitudinal orientation of the filter there would be a substantial risk that the slightest deformation of the filter cross-section would result in the formation of false air ducts extending along the longitudinal orientation of the filter, which in turn would result in a substantial change of the flavour and composition of the smoke inhaled by the smoker. Furthermore, such adhesive joining of the covering paper strip to the filter elements in a filter with a chamber containing free-flowing filter material would be unusable because in tightly filled chambers there would be an excessive risk that a slight deformation of the filter cross-section would cause granulate particles to pass through the ducts formed between two adhesive strips into the mouth of the smoker which would be extremely unpleasant for the latter. If the covering paper strip were to be adhesively joined to the filter elements only along the circumference of the filter elements which are to be wrapped along circles situated at a distance from each other it would of course be impossible for the cutting places to be arranged so that they always extend through the relatively narrow adhesively joined ranges so that the covering paper strip would be adhesively joined to the outside of the wrapped filter elements at the cutting places when the filter strand is cut into individual portions. However, if this is not the case, i.e. if the adhesive region is situated further towards the interior at a distance from the cutting place, the covering paper strip would project slightly from the wrapped filter element at the cutting place and give rise to frequent defects in the filter machine by means of which the filters are joined to the tobacco part of the cigarette, as has been shown by tests.

It is the object of the present invention to provide a method for producing a cigarette filter unit which is provided with a porous or perforated covering strip and in which reliable uniform adhesive joining of the covering strip takes place over the entire circumference of the wrapped filter elements and in distribution over their entire length and in which perfect adhesive joining of the covering paper strip to the wrapped filter elements is forcibly obtained at the cutting places and nevertheless important regions of the porous or perforated wrapping paper strip are kept free of adhesive substance. Furthermore, the method according to the invention is to facilitate the production of perfect chamber filters with porous or perforated covering strips without the risk of undesirable escape of free-flowing filter material on the mouth side filter end.

According to the invention the problem is solved in a method of the kind described hereinbefore by the use of a covering strip in which the adhesive substance is applied to the covering strip along coating tracks which are at least approximately equidistant from each other and extend at an angle to the longitudinal orientation of the covering strip and the lateral spacing between coating tracks is such that at any random place of the covering strip thus treated there will be at least three adhesive substance places along a line of observation extending perpendicularly to the longitudinal orientation of the covering strip.

To achieve a procedure which is simple as possible it is convenient that the adhesive substance is applied to the covering strip on coating tracks which extend parallel with each other. To this end it is advantageous that the adhesive substance is applied to the covering strip along straight lines, more particularly lines which extend at an angle $\alpha$ of 45° with respect to the longitudinal orientation of the covering strip.

To obtain a useful compromise between sufficient adhesive joining and maximum covering paper surface which is free of adhesive substance it is convenient that the lateral spacing (a) between the coating tracks is at least three times as large as the width (b) of the adhesive substance coating tracks.

In order to obtain an even larger covering paper surface which is free of adhesive substance it is advantageous that the adhesive substance is applied in the form of spots or short lines.

It is of course also possible that the adhesive substance is applied to the covering strip in the form of a plurality of curves, more particularly sinusoidal curves, which are displaced parallel with each other.

It is however important to ensure that the adhesive substance is applied to the covering strip so that at least four adhesive substance places will be disposed at any random place of the covering strip thus treated along a line of observation extending perpendicularly to the longitudinal orientation of the covering strip.

It is possible to use adhesive substance based on thermoplastics, for example polyvinyl acetate or a so-called hot melt adhesive based on wax, for example of the kind sold by Bostich, DuPont de Nemours, Eastman, Henkel Chemie and Mobil. The adhesive substance can be applied to the covering paper strip directly on the cigarette filter production machine prior to the filter elements being wrapped with the porous or perforated wrapping paper strip. It is of course also possible to provide the covering paper strip with the adhesive substance on a separate adhesive substance coating machine in accordance with the inventive method and to keep it in stock before arranging such paper strip in reels on the filter production machine. During production of the filters the adhesive substance disposed on the covering paper strip surrounding the filter elements is then briefly heated by means of a heating unit and therefore liquefied thus achieving adhesive joining between the covering paper strip and the filter elements.

To form chamber filters it is known to move the filter strand, provided with chamber filling openings, past a filling member for the introduction of granulated filter material into the filter chambers and subsequently after completed filling and to close the chamber filling openings to arrange a continuous closing strip over the filter strand to cover the chamber filling openings and to adhesively join it to the filter strand. To this end it is advantageous to use a closing strip to which the adhesive substance is applied along coating tracks which extend at an angle to the longitudinal orientation of the closing strip and are at least approximately equidistant from each other. To obtain better closing of the filter chambers filled with free-flowing filter material and more particularly when using pulverized filter material it is advantageous to use a closing strip each of whose longitudinal edges is additionally provided with a strip of adhesive.

The subject of the present invention also relates to apparatus for performing the method according to the invention and such apparatus is characterized in that the means for applying adhesive substance to the covering strip or the closing strip which is moved forward along its longitudinal orientation has an applicator roller which is rotatable about its longitudinal axis and is provided on its circumference with adhesive substance receptor grooves or adhesive substance transfer ribs and the length of the applicator roller corresponds at least to the width of the covering or closing strip.

In order that the least amount of surface of the covering paper strip is provided with adhesive substance, i.e. to obtain the largest possible air-permeable surface of the covering paper strip, it is advantageous that the adhesive substance transfer ribs are subdivided by means of recesses into a plurality of rib portions.

The subject of the present invention also relates to apparatus for performing the method according to the invention and is characterized in that the means for applying adhesive substance to the covering strip or to the closing strip comprises an applicator device which can be reciprocated continuously perpendicularly to the longitudinal orientation of the strip and is provided with a plurality of exit ports, situated at a distance from each other in the longitudinal orientation of the strip which moves forward continuously along its longitudinal orientation and is to be provided with adhesive substance.

The subject of the present invention also relates to a cigarette filter unit produced in accordance with the method of the invention, more particularly a cigarette filter unit having a chamber which contains free-flowing filter material.

The invention will be explained hereinbelow by reference to the accompanying drawing in which.

Figure 1:
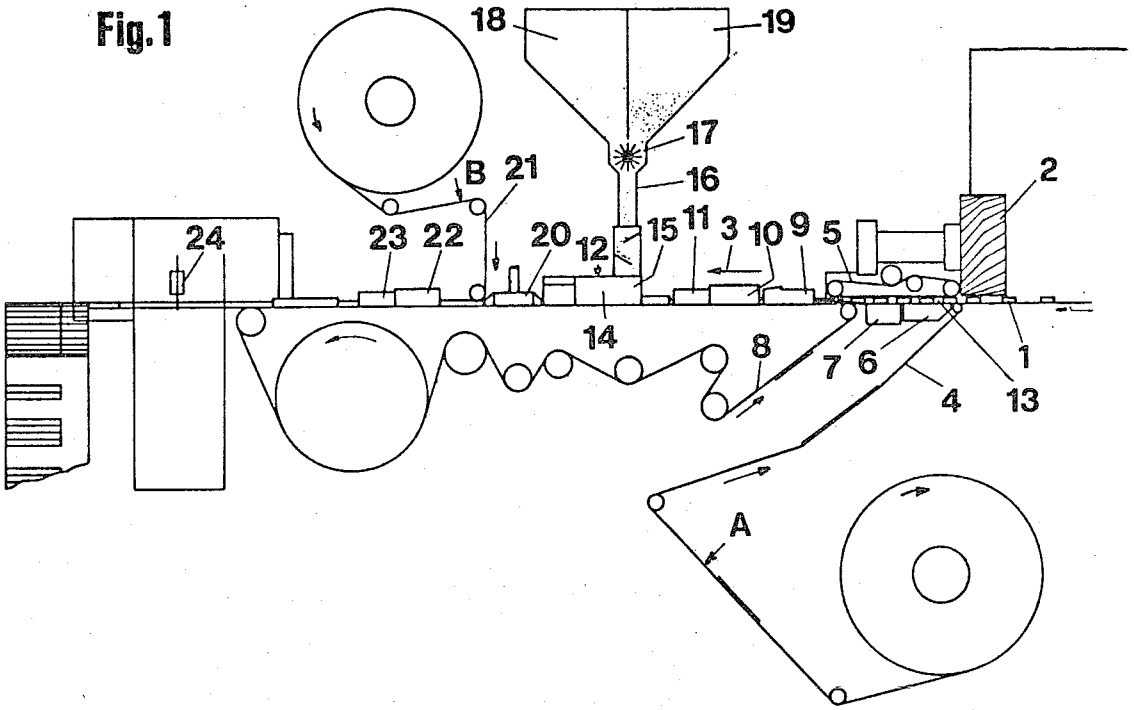
FIG. 1 is a diagrammatic side view of a cigarette filter production machine.

As can be seen by reference to FIG. 1 the filter elements 1 consisting of cellulose or acetate are aligned with each other in alternate axial configuration in the illustrated device, are moved forward in the direction of the arrow 3 and, to enable chamber filters to be produced, are placed at uniform distances from each other.

Thereafter the uniformly spaced and axially aligned filter elements 1 are continuously supplied to a likewise continuously supplied covering strip 4, are placed thereon and are guided laterally through guide members and are retained in their relative position by means of a presser belt 5 which is disposed above the covering strip 4 and circulates in synchronism therewith and the said filter elements are then moved forward together with the covering strip 4. As can be seen by reference to FIG. 2 the side of the covering strip 4 nearest to the filter elements is provided with an adhesive substance which can be softened by heat, for example with a thermoplastics material or a "hot melt" material so that it is possible for the individual filter elements 1 to be secured by means of a heating element 6 on the covering strip 4 immediately after being transferred thereto so that any relative displacement, i.e. any change of their distance between them, is rendered impossible. To this end the heating element 6 can be pressed from the bottom against the covering strip 4 and can thus be directly pressed against the filter elements 1 which are to be secured. The heating element 6 is arranged so that it can be removed from the covering strip 4 when this is at rest in order to avoid burning thereof. After passing by the heating element 6 the covering strip 4 is guided over a cooling member 7 which is cooled with water and the adhesive substance coating associated with the covering strip 4 and softened by the heating element 6 solidifies and the filter elements 1 are secured on the said covering strip.

After the individual filter elements 1 are secured on the covering strip 4 the latter is conducted to an endless conveyor belt 8 and these parts together reach a two-part moulding unit 9 in which the covering strip 4, of 21 to 22 mm width, and in the course of its forward motion it is wrapped with the exception of a filling slot of approximately 3 to 4 mm, around the filter elements 1 which have a circumference of 25 mm. To obtain complete adhesive joining of the covering strip 4 to the filter elements 1 and to ensure precise fixing of the filter diameter the above-mentioned configuration is transferred by means of the conveyor belt 8 first beneath a second heating element 10 which covers the top half of the strand and immediately thereafter beneath a second cooling element 11 which also covers the top half of the strand.

The strand formed in this manner is then conveyed by means of the conveyor belt 8 to a filling part 12, described in detail in the Swiss Patent Specification No. . . . (Swiss Patent Application No. 15905/75) which said filling part is provided for the introduction of free-flowing filter material, for example activated carbon, into the chambers 13 which are formed between the individual filter elements 1. To increase the charge of the chambers 13 with free-flowing filter material the downwardly oriented exit side of the storage vessel 14 associated with the filling part 12 is connected via a sliding member which bears sealingly on the side edges of the covering strip 4 and on the circumferential regions of the filter elements 1 disposed therebetween with a suction device 15 disposed upstream of the filler aperture of the filling part 12 as seen in the direction of motion of the covering strip 4, as may also be seen by reference to the above-mentioned patent specification.

The chambers 13 evacuated in this manner then pass beneath the exit slot which forms the filler opening of the storage vessel 14 whereupon the free-flowing filter material disposed therein is drawn suddenly into the chambers 13 which appear beneath the sliding surface. As can be seen by reference to FIG. 1 the storage vessel 14 is connected by means of a socket 16 and a metering device 17 to two storage vessels 18 and 19 which are designed for accommodating two different kinds of free-flowing filter material.

After the chambers 13 are filled with free-flowing filter material suction is applied by means of a suction device 20 to the surface regions of the filter elements 1 exposed between the side edges of the covering strip 4 and suction is also applied to the covering strip side edges so that any free-flowing filter material which may be present in these regions is removed and any blackening of the surface regions by such material is avoided.

Figure 3:
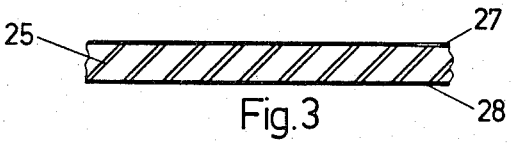
FIG. 3 shows to an enlarged scale a plan view of the closing strip in the direction of the arrow B of FIG. 1.

Downstream of the suction device 20 a closing strip 21, the width of which is slightly greater than the width of the filling slot, is supplied from above over the filling slot and is adhesively fixed by means of a heatable element 22 on the exposed surface of the filter element 1 and on the side edges of the covering strip 4 by softening of the adhesive substance coating which is applied to the covering strip 24 and is shown in FIG. 3. The said heatable element 22 is mounted so that it can be pivoted in the upward direction to enable it to be lifted off the stationary covering strip 21 if the apparatus is shut down.

To obtain a precise external shape for the cigarette filter units the strand, provided with the heated closing strip 21, is passed beneath a water-cooled cooling member 23 where the softened adhesive substance of the closing strip 21 solidifies.

After the filter strand is closed by adhesive joining it is supplied to a cutting device 24 where it is subdivided so that the length of each filter structure amounts to four or six times the length of a single filter intended for one cigarette.

Figure 2:
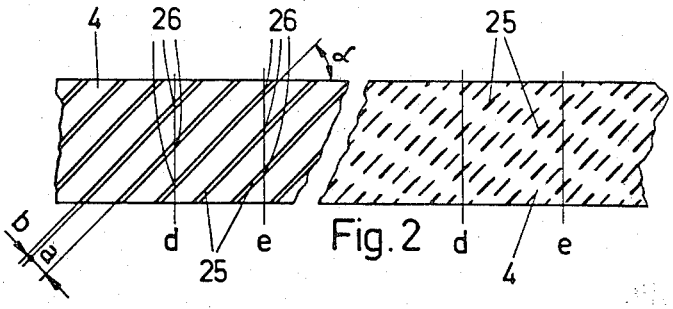
FIG. 2 shows to an enlarged scale a plan view of the covering paper strip in the direction of the arrow A of FIG. 1.

In the apparatus illustrated in FIG. 1 a covering strip 4, as shown on the left of FIG. 2, of highly porous paper is employed in which the adhesive substance is applied to coating tracks 25 on the covering strip 4 at an angle $\alpha$ of 45° relative to the longitudinal orientation of the covering strip and the said coating tracks 25 have a lateral spacing a from each other which is such that at any desired place of the covering strip 4 treated in this manner and along a line of observation d or e extending perpendicularly to the longitudinal orientation of the covering strip there will be at least three adhesive substance places 26. This ensures reliable adhesive joining of the covering strip 4 to the external surfaces of the filter elements 1 without the air permeability of the covering strip 4 being excessively reduced by the adhesive substance coating tracks 25 and with any step of the cutting device 24 at any desired place of the filter strand the covering strip is always sufficiently adhesively joined to the filter element 1 disposed at the cutting place so that subsequently no defects which could lead to breakdowns are caused in the filter machine during the subsequent connection to the tobacco part of the cigarette.

It has been found advantageous that the lateral spacing a between the adhesive substance tracks 25 be at least three times as large as their width b.

As can be seen by reference to the right-hand side of FIG. 2 the adhesive substance can also be applied in the form of spots or short lines on the covering strip 4 and with an arrangement of this kind of the adhesive substance it is important to ensure that there will always be at least three adhesive substance places along any desired line of observation d.

As can be seen from FIG. 3 the closing strip 21 is provided with adhesive substance coating tracks 25 in the same manner as the covering strip 4. To reliably prevent any escape of free-flowing filter material from the chambers 13 which are closed by the closing strip 21 each longitudinal edge thereof is provided with adhesive substance strips 27 and 28 in addition to the adhesive substance tracks 25.

Figure 4:
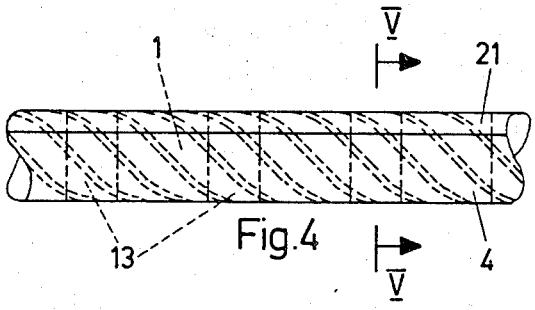
FIG. 4 is a side view of a cigarette filter strand produced in accordance with the invention.
Figure 5:
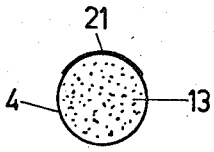
FIG. 5 is a section along the line V—V of FIG. 4.

A side view of part of a completely adhesively joined filter strand is shown in FIG. 4 and the adhesive substance tracks which are not visible from the outside are shown in broken lines. FIG. 5 is a section along the line V—V of FIG. 4.

The covering strip 4 and the closing strip 21 can be provided with adhesive substance in the apparatus illustrated in FIG. 1 after being unreeled from a corresponding supply reel. However, it is of course also possible to provide the strips 4 and 21 with the adhesive substance before the strips are introduced into the device illustrated in FIG. 1 and to store such strips in the form of supply reels.

Figure 8:
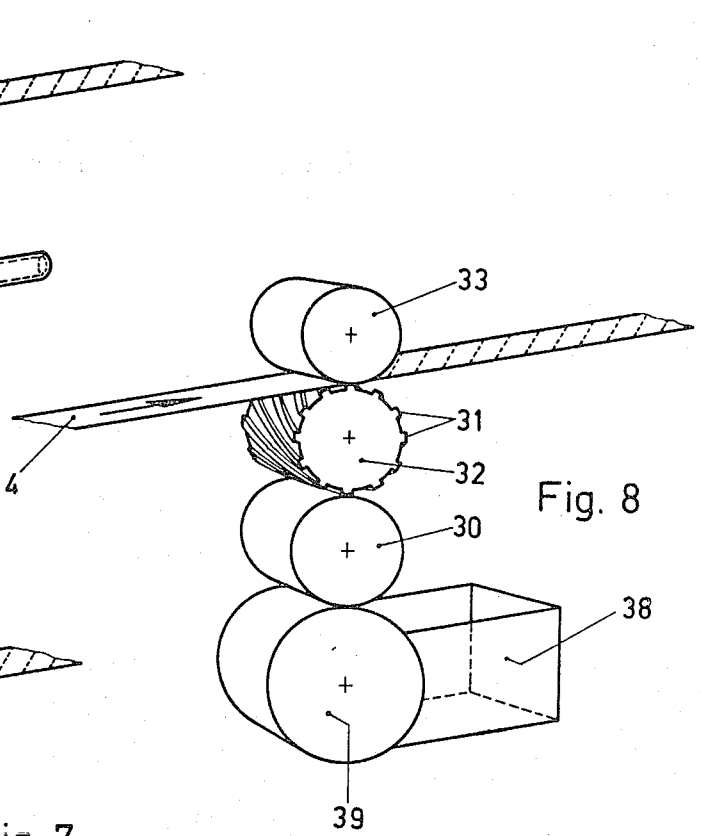
FIG. 8 is a perspective view of a third exemplified embodiment of means for applying adhesive substance to the covering paper strip.
Figure 6:
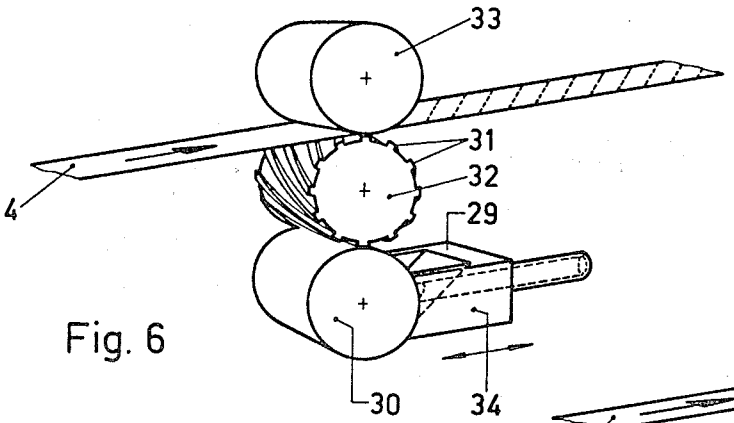
FIG. 6 is a perspective view of a first exemplified embodiment of means for applying adhesive substance to the covering paper strip.
Figure 7:
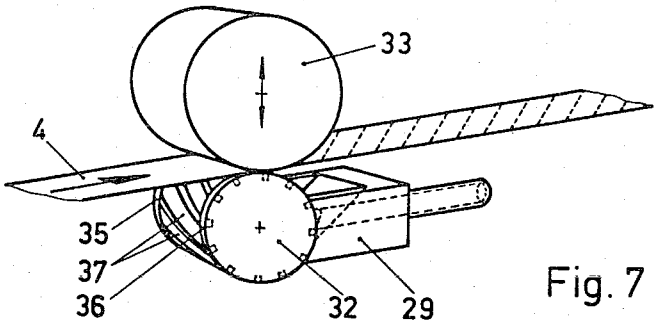
FIG. 7 is a perspective view of a second exemplified embodiment of means for applying adhesive substance to the covering paper strip.

FIGS. 6, 7 and 8 show different embodiments of means for applying adhesive substance to a covering strip 4. Identical means can also be used for the closing strip 21.

In the device illustrated in FIG. 6 the adhesive substance is applied to the covering strip 4 in a manner similar to that employed for transferring printer's ink in the letter-press process. The adhesive substance is delivered to an adhesive substance transfer roller 30 by means of a wide slot nozzle in an adhesive substance delivery device 29 and is thereafter transferred to the adhesive substance transfer ribs 31 of an applicator roller 32. Opposite to the rotatable applicator roller 32 there is disposed a rotatable contact roller 33 and the covering strip 4, consisting of highly porous paper, is passed between the two rollers 32 and 33 and in engagement therewith for the purpose of applying adhesive substance tracks 25. In this device hot melt adhesive is supplied under pressure to the adhesive substance delivery device 29. The quantity of adhesive substance is regulated by sliding the adhesive substance delivery device 29 relative to the surface of the roller 30 in the direction of the arrows 34.

In the device illustrated in FIG. 7 the adhesive substance is supplied to the covering strip 4 in a manner similar to that applied for transferring printer's ink in the intaglio printing process, namely by the adhesive substance being delivered into receptor grooves 37 of the applicator 32 from the adhesive substance delivery device 29 which bears on the side edges 35 and 36 of the applicator roller 32 and is then transferred to the surface of the covering strip 4. The amount of adhesive substance thus transmitted is defined by the depth of the adhesive substance receptor grooves 37. Hot melt adhesive is also supplied under pressure to the adhesive substance delivery device 29.

Figure 9:
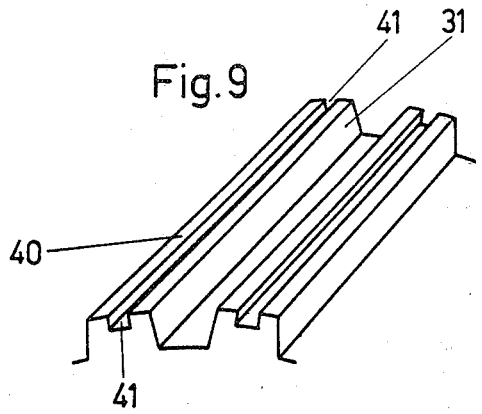
FIGS. 9 to 11 show perspective views of modified embodiments of the applicator rib associated with the applicator roller which is illustrated in FIG. 6.

In the device illustrated in FIG. 8 a thermoplastic adhesive substance, for example polyvinyl acetate, is contained in a storage vessel 38. A delivery roller 39 is rotatably and sealingly disposed on the open front of the vessel and in the course of rotation delivers adhesive substance obtained from the storage vessel 38 to an adhesive substance transfer roller 30. From the adhesive substance transfer roller 30 the substance is transferred as in the device illustrated in FIG. 6. As can be seen by reference to FIG. 9 each transfer surface 40 of the adhesive substance transfer ribs 31 can be provided with an adhesive substance receptor groove 41 in order to improve the delivery of adhesive substance to the surface of the covering strip 4.

Figure 10:
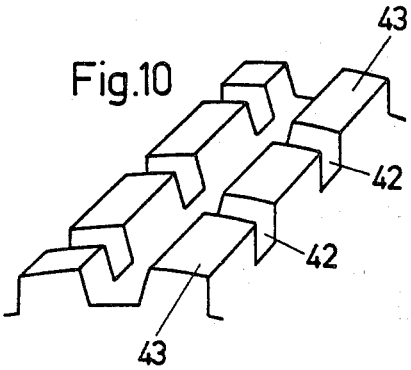
Figure 11:
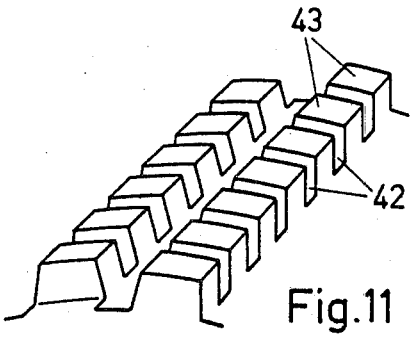

The adhesive substance transfer ribs 31 can be subdivided by recesses 42 into a plurality of rib portions 43 in order to obtain the delivery of adhesive substance as indicated in FIG. 2 on the right to which end the embodiment illustrated in FIG. 10 transfers the adhesive substance in the form of short lines and the embodiment illustrated in FIG. 11 transfers the adhesive substance in the form of dots to the surface of the covering strip.

Figure 12:
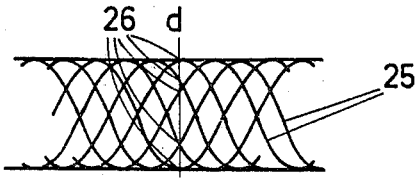
FIG. 12 is a plan view, analogous to FIG. 2, of a covering paper strip which is provided in a different manner with adhesive substance.
Figure 13:
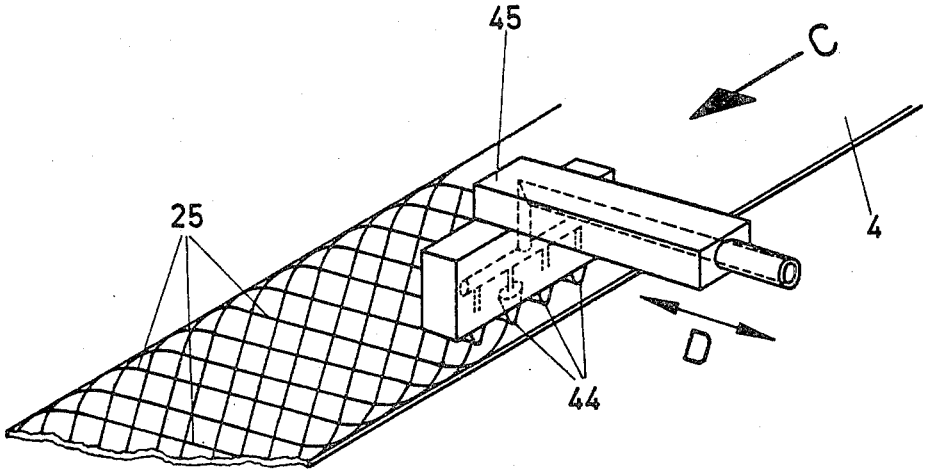
FIG. 13 is a perspective view of a system for obtaining the adhesive substance application illustrated in FIG. 12.

FIG. 12 discloses the means by which the adhesive substance is applied in the form of a plurality of successive sinusoidal curves on to the surface of the covering strip 4. Adhesive substance coating means suitable to this end are shown diagrammatically in FIG. 13. During the continuous forward motion of the covering strip in the direction of the arrow C a coating part 45 which has seven exit nozzles 44 and is connected to the supply of adhesive substance is continuously reciprocated, perpendicular to the longitudinal extent of the covering strip and in the direction of the arrow D, so as to produce sinusoidal adhesive substance tracks 25. In selecting the distance between the exit nozzles 44 from each other it is essential to ensure that at least three places 26 of adhesive substance will be situated at any desired place of the covering strip 4 treated in this manner along a line of observation d which extends perpendicularly to the longitudinal orientation of the covering strip.

Figure 14:
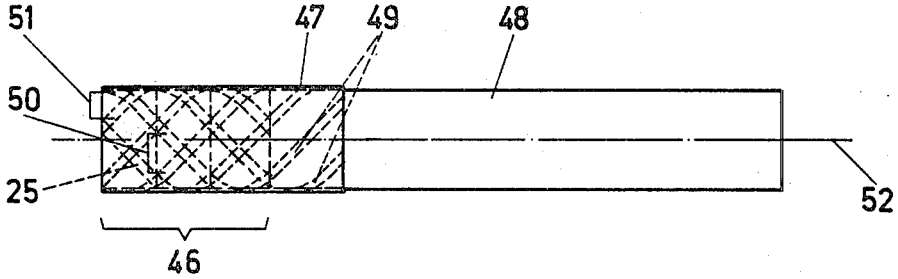
FIG. 14 is a side view of a filter cigarette which is provided with a cigarette filter produced in accordance with the invention.

FIG. 14 is a side view of a filter cigarette produced in accordance with the invention. As can be seen by reference to FIG. 14 the chamber filter 46 is connected to the tobacco part 48 by means of a connecting strip 47. The connecting strip 47 in which the adhesive substance is applied along adhesive substance coating tracks 49 which extend at an angle to or perpendicular to the adhesive substance tracks 25 on the covering strip 4 so that in any random arrangement of the connecting strip 47 over the covering strip 4, those surfaces of the covering and connecting strip 4 or 47 which are free of adhesive substance are always the same in order that identical air permeability in the filter region is ensured for each cigarette. In the example illustrated in FIG. 14 the connecting strip 47 was provided with adhesive substance coating tracks 49 extending perpendicularly to the adhesive substance coating tracks 25 disposed on the covering strip 4, i.e., as can be seen by reference to FIG. 15, the adhesive substance was applied to the connecting strip 47 along equidistant straight lines 25 which extend at an angle $\beta$ of 135° with respect to the longitudinal extent of the connecting strip.

By virtue of the above-described construction of the chamber filter 46 the helical characteristic of the adhesive substance tracks 25 and the regions therebetween which are not adhesively joined reliably prevent free-flowing filter material escaping from the filter chamber 13 into the mouth of the smoker even if the chamber filter is severely deformed. In selecting the lateral spacing between adhesive substance tracks 25 it is essential to ensure that the said tracks 25 are arranged sufficiently close side by side so that the two end sides 50 and 51 of the helical regions formed between the adhesive substance tracks 25 but without adhesive joining do not overlap when observed along the axial orientation of the cigarette filter 46 but are situated at a distance from each other and adjacent to each other so that any granulated filter particle which escapes from the chamber 13 into such a region which is not adhesively joined cannot in any case reach the mouth of the smoker through the region without adhesive joining on a straight line which is parallel with the filter axis. Only in this way is it possible to achieve reliable closure of the filter chamber 13 which is tightly filled with free-flowing filter material.

If no chamber filter is produced the plug-like filter elements 1, which are then arranged in direct sequence on the covering strip 4, are merely wrapped thereby in which case the width of the covering strip 4 of 27 mm for a filter element circumference of, for example, 25 mm is sufficiently large to enable the side edges of the covering strip 4 to overlap on the finished filter. To obtain sealing-tight closure of the filter covering it will then be possible to provide adhesive substance along the longitudinal direction on the first side edge of the covering strip which bears externally on the second side edge, i.e. by analogy to the closing strip 21 illustrated in FIG. 3 but in the example only along one side edge.

We claim:

1. In an apparatus for producing a cigarette filter unit with the aid of a porous and continuously supplied covering strip transported in a moving direction, so as to produce a filter strand, the covering strip being at least partially wrapped around said filter strand, and cutting means for cutting the filter strand into a multiplicity of units, each of said units constituting said filter unit, the improvement comprising:

applicator roller means disposed adjacent said covering strip and including adhesive substance receptor means disposed on the circumference of said applicator roller means for applying an adhesive substance to said covering strip along a plurality of approximately equispaced coating tracks, said applicator roller means being arranged to orient each coating track so that it forms a predetermined angle with said moving direction, and so that said adhesive substance will be applied on at least three locations separated from one another along a line at right angles to the moving direction of said covering strip, said adhesive substance receptor means including a plurality of transfer ribs, each of said transfer ribs including a transfer surface provided with a receptor groove for receiving said adhesive substance.

2. An apparatus as claimed in claim 1, wherein each of said transfer ribs is composed of a plurality of members extending in a predetermined direction and separated from one another by corresponding recesses.

* * * * *